US005925094A

United States Patent [19]

Kimura

[11] Patent Number: 5,925,094

[45] Date of Patent: Jul. 20, 1999

[54] ANALOG MULTIPLIER USING TRIPLE-TAIL CELL

[75] Inventor: Katsuji Kimura, Tokyo, Japan

[73] Assignee: NEC Corporation, Tokyo, Japan

[21] Appl. No.: 08/976,719

[22] Filed: Nov. 24, 1997

[30] Foreign Application Priority Data

Nov. 22, 1996 [JP] Japan ..... 8-327858

[51] Int. Cl.[6] ..... G06G 7/16

[52] U.S. Cl. ..... 708/835; 327/357

[58] Field of Search ..... 364/841; 327/357

[56] References Cited

U.S. PATENT DOCUMENTS

| | | | |
|---|---|---|---|
| 4,586,155 | 4/1986 | Gilbert | 364/841 |
| 4,764,892 | 8/1988 | Thomas | 364/841 |
| 5,381,113 | 1/1995 | Kimura . | |
| 5,444,648 | 8/1995 | Kimura . | |
| 5,481,224 | 1/1996 | Kimura . | |
| 5,485,119 | 1/1996 | Kimura . | |
| 5,581,210 | 12/1996 | Kimura . | |
| 5,602,509 | 2/1997 | Kimura . | |
| 5,617,052 | 4/1997 | Kimura . | |
| 5,712,810 | 1/1998 | Kimura . | |
| 5,754,076 | 5/1998 | Kimura . | |

OTHER PUBLICATIONS

Y.H. Kim et al., "Four–Quadrant CMOS Analogue Multiplier", *Electronics Letters,* vol. 28, No. 7, Mar. 26, 1992, pp. 649–650.

*Primary Examiner*—Tan V. Mai

*Attorney, Agent, or Firm*—Sughrue, Mion, Zinn Macpeak & Seas, PLLC

[57] ABSTRACT

An analog multiplier that decreases the circuit current consumption is provided. This multiplier includes a first triple-tail cell of first, second, and third transistors driven by a first tail current, and a second triple-tail cell of fourth, fifth, and sixth transistors driven by a second tail current. First and second constant current sources supplies first and second constant currents to the third and sixth transistors, respectively. The first and second tail currents are controlled by first and second tail current controllers, respectively The first and second tail current controllers controls the first and second tail currents so that the current changes of the third and sixth transistors are canceled, respectively, where the current changes are caused by the second input voltage applied across the input terminals of the third and sixth transistors.

10 Claims, 5 Drawing Sheets

ANALOG MULTIPLIER USING TRIPLE-TAIL CELL

BACKGROUND OF THE INVENTION

1. Field of the Invention

The present invention relates to an analog multiplier for multiplying two input signals and more particularly, to an analog multiplier using two triple-tail cells, which is suitable for a Large-Scale Integrated circuit (LSI) and capable of completely linear operation.

2. Description of the Prior Art

A conventional four-quadrant analog multiplier of this type is shown in FIG. 1, which has a Complementary MOS (CMOS) structure. This multiplier is disclosed in a paper, IEE Electronics Letters, Vol. 28, No. 7, pp. 649–650, March 1992, entitled "Four-Quadrant CMOS ANALOGUE MULTIPLIER", written by Y. H. Kim and S. B. Park.

This paper includes some mistakes in its circuit diagram. The circuit configuration shown in FIG. 1 is a corrected one by the inventor, Kimura. The operation principle of this conventional multiplier explained below was given through the inventor's analysis.

In FIG. 1, this multiplier includes a first triple-tail cell of n-channel Metal-Oxide-Semiconductor Field-Effect Transistors (MOSFETs) M101, M102, and M105 whose sources are coupled together and a second triple-tail cell of n-channel MOSFETs M103, M104, and M106 whose sources are coupled together.

The coupled sources of the MOSFETs M101, M102, and M105 of the first triple-tail cell are connected to one terminal of a constant current sink 103 sinking a constant current $I_B$. The other terminal of the constant current sink 103 is applied with a power supply voltage $V_{ss}$. The first triple-tail cell is driven by the constant current (i.e., tail current) $I_B$.

The coupled sources of the MOSFETs M103, M104, and M106 of the second triple-tail cell are connected to one terminal of a constant current sink 104 sinking a same constant current $I_B$ as the constant current sink 103. The other terminal of the constant current sink 103 is applied with the power supply voltage $V_{ss}$. The second triple-tail cell is driven by the same constant current (i.e., tail current) $I_B$ as the first triple-tail cell.

Gates of the MOSFETs M101, M102, and M105 of the first triple-tail cell are applied with input voltages $(V_x/2)$, $(-V_x/2)$, and $(-V_y/2)$, respectively. Gates of the MOSFETs M103, M104, and M106 of the second triple-tail cell are applied with input voltages $(-V_x/2)$, $(-V_x/2)$, and $(V_y/2)$, respectively.

Drains of the MOSFETs M101 and M103 are coupled together to be connected to an input terminal of a current mirror circuit 105. An output terminal of the current mirror circuit 105 is connected to an input terminal of a current mirror circuit 107. A drain of the MOSFET M105 is connected to a constant current source 101 supplying a constant current $I_{B1}$.

Drains of the MOSFETs M102 and M104 are coupled together to be connected to an input terminal of a current mirror circuit 106. An output terminal of the current mirror circuit 106 is connected to an output terminal of the current mirror circuit 107. A drain of the MOSFET M106 is connected to a constant current source 102 supplying a same constant current IaI as the constant current source 101.

A p-channel MOSFET M107 is further provided to the first triple-tail cell. A drain of the MOSFET M107 is connected to the coupled sources of the M101, M102, and M105 of the first triple-tail cell. A gate of the MOSFET M107 is connected to the drain of the MOSFET M105. A source of the MOSFET M107 is applied with a power supply voltage $V_{DD}$.

A p-channel MOSFET M108 is further provided to the second triple-tail cell. A drain of the MOSFET M108 is connected to the coupled sources of the M103, M104, and M106 of the second triple-tail cell. A gate of the MOSFET M108 is connected to the drain of the MOSFET M106. A source of the MOSFET M108 is applied with the power supply voltage $V_{DD}$.

Next, the operation principle of the conventional multiplier shown in FIG. 1 is explained below.

It is supposed that the MOSFETs M101 to M108 are matched in characteristics and that the channel-length modulation and the body effect can be ignored. Then, if a drain current $I_D$ of each MOSFET varies with its gate-to-source voltage $V_{GS}$ according to the square-law characteristic, the drain current $I_D$ is typically expressed by the following equation (1).

$$I_D=\beta(V_{GS}-V_{TH})^2 \tag{1}$$

In the equation (1), $V_{TH}$ is the threshold voltage of the MOSFET and β is the transconductance parameter thereof. The transconductance parameter β is defined as $$\beta=\frac{\mu C_{OX}}{2}\cdot\frac{W}{L}$$

where $\mu$ is the mobility of a carrier, $C_{OX}$ is the gate-oxide capacitance per unit area, and W and L are a gate width and a gate length of each MOSFET, respectively.

Here, drain currents of the MOSFETs M101, M102, M103, M104, M105, M106, M107, and M108 are expressed as $I_{D1}$, $I_{D2}$, $I_{D3}$, $I_{D4}$, $I_{D5}$, $I_{D6}$, $I_{D7}$, and $I_{D8}$, respectively. Since the drain current $I_{D7}$ flows into the constant current sink 103 through the coupled sources of the MOSFETs M101, M102, and M105, the sum of the drain currents $I_{D1}$, $I_{D2}$, $I_{D5}$, and $I_{D7}$ is equal to the constant tail current $I_B$ of the constant current sink 103. Therefore, the following equation (2) is established.

$$I_B=I_{D1}+I_{D2}+I_{D5}+I_{D7} \tag{2}$$

The gate of the MOSFET M107 is connected to the drain of the MOSFET M105 and therefore, the drain current $I_{D7}$ of the MOSFET M107 is controlled by the drain voltage of the MOSFET M105.

The MOSFET M105 is driven by the constant current $I_{B1}$ supplied by the constant current source 101, in other words, the drain current $I_{D5}$ of the MOSFET M105 is kept at $I_{B1}$ (i.e., $I_{D5}=I_{B1}$). Therefore, a gate-to-source voltage $V_{GS5}$ of the MOSFET M105 needs to be kept constant. This means that a source voltage $V_{ss}$ of the MOSFET M105, which is equal to source voltages of the MOSFETs M101 and M102, needs to vary according to an applied gate voltage $V_{G5}$ of the MOSFET M105 to provide the constant gate-to-source voltage $V_{GS5}$.

Since the input voltage $(-V_y/2)$ is applied to the gate of the MOSFET M105, the gate voltage $V_{G5}$ of the MOSFET M105 is given as $[V_R-(½)V_y]$, where $V_R$ is a specific reference voltage. Therefore, the gate-to-source voltage $V_{GS5}$ of the MOSFET M105 is given as $$V_{GS5}=V_{G5}-V_{SS}=V_R-(½)V_y-V_{SS}.$$

Accordingly, the drain current $I_{D5}$ of the MOSFET M105 is expressed as the following equation (3) using the above equation (1).

$$I_{D5}=\beta(V_{GS5}-V_{TH})^2=\beta(V_R\tfrac{1}{2}V_y-V_{S5}-V_{TH})^2=I_{B1} \quad (3)$$

From the equation (3), the common source voltage $V_{S5}$ of the MOSFETs M1, M2, and M5 is given by the following expression (4).

$$V_{S5} = V_R - \frac{1}{2}V_y - V_{TH} - \sqrt{\frac{I_{B1}}{\beta}} \quad (4)$$

It is seen from the expression (4) that the MOSFET M105 serves to shift or vary the common source voltage $V_{S5}$ according to the applied input voltage ($-V_y/2$), thereby keeping the gate-to-source voltage $V_{GS5}$ of the MOSFET M105 constant.

Similarly, the gate voltages $V_{G1}$ and $V_{G2}$ of the MOSFETs M101 and M102 are given as $[V_R-(\tfrac{1}{2})V_x]$ and $[V_R+(\tfrac{1}{2})V_x]$, respectively. Therefore, the gate-to-source voltages $V_{GS1}$ and $V_{GS2}$ of the MOSFETs M101 and M102 are given as $$V_{GS1}=V_{G1}-V_{S1}=V_R-(\tfrac{1}{2})V_x-V_{S5}, \text{ and}$$

$$V_{GS2}=V_{G2}-V_{S2}=V_R+(\tfrac{1}{2})V_x-V_{S5}.$$

Accordingly, using the above equation (4), the drain currents $I_{D1}$ and $I_{D2}$ of the MOSFETs M101 and M102 are given by the following equations (5) and (6), respectively.

$$I_{D1} = \beta(V_{GS1} - V_{TH})^2 = \beta\left(V_R - \frac{1}{2}V_x - V_{S5} - V_{TH}\right)^2 = \beta\left[-\frac{1}{2}V_x + \frac{1}{2}V_y + \sqrt{\frac{I_{B1}}{\beta}}\right]^2 \quad (5)$$

$$I_{D2} = \beta\left[\frac{1}{2}V_x + \frac{1}{2}V_y + \sqrt{\frac{I_{B1}}{\beta}}\right]^2 \quad (6)$$

As a result, from these equations (5) and (6), the differential output current ($I_{D2}-I_{D2}$) of the MOSFETs M101 and M102 is expressed by the following equation (7).

$$I_{D1} - I_{D2} = -2\beta V_x\left[\frac{1}{2}V_y + \sqrt{\frac{I_{B1}}{\beta}}\right] \quad (7)$$

Similarly, since the drain current $I_{D8}$ flows into the constant current sink 104 through the coupled sources of the MOSFETs M103, M104, and M106, the sum of the drain currents $I_{D3}$, $I_{D4}$, $I_{D6}$, and $I_{D8}$ is equal to the constant tail current $I_B$ of the constant current sink 104. Therefore, the following equation (8) is established.

$$I_B=I_{D3}+I_{D4}+I_{D6}+I_{D8} \quad (8)$$

The gate of the MOSFET M108 is connected to the drain of the MOSFET M106 and therefore, the drain current $I_{D8}$ of the MOSFET M10B is controlled by the drain voltage of the MOSFET M106.

The MOSFET M106 is driven by the constant current $I_{B1}$ supplied by the constant current source 102, in other words, the drain current $I_{D6}$ of the MOSFET M106 is kept at $I_{B1}$ (i.e., $I_{D6}I_{B1}$). Therefore, a gate-to-source voltage $V_{GS6}$ of the MOSFET M106 needs to be kept constant. This means that a source voltage $V_{S6}$ of the MOSFET M106, which is equal to source voltages of the MOSFETs M103 and M104, needs to vary according to an applied gate voltage $V_{G6}$ of the MOSFET M106 to provide the constant gate-to-source voltage $V_{GS6}$.

Since the input voltage ($V_y/2$) is applied to the gate of the MOSFET M106, the gate voltage $V_{G6}$ of the MOSFET M106 is given as $[V_R+(\tfrac{1}{2})V_y]$. Therefore, the gate-to-source voltage $V_{GS6}$ of the MOSFET M106 is given as $$V_{GS6}=V_{G6}-V_{S6}=V_R+(\tfrac{1}{2})V_y-V_{S6}.$$

Accordingly, the drain current $I_{D6}$ of the MOSFET M106 is expressed as the following equation (9) using the above equation (1).

$$I_{D6}=\beta(V_{GS6}-V_{TH})^2=\beta(V_R+\tfrac{1}{2}V_y-V_{S6}-V_{TH})^2=I_{B1} \quad (9)$$

From the equation (9), the common source voltage $V_{S6}$ of the MOSFETs M3, M4, and M6 is given by the following expression (10).

$$V_{S6} = V_R + \frac{1}{2}V_y - V_{TH} - \sqrt{\frac{I_{B1}}{\beta}} \quad (10)$$

It is seen from the expression (10) that the MOSFET M106 serves to shift or vary the common source voltage Vsg according to the applied input voltage ($V_y/2$), thereby keeping the gate-to-source voltage $V_{GS6}$ of the MOSFET M106 constant.

Similarly, the gate voltages $V_{G3}$ and $V_{G4}$ of the MOSFETs M103 and M103 are given as $[V_R+(\tfrac{1}{2})V_x]$ and $[V_R-(\tfrac{1}{2})V_x]$, respectively. Therefore, the gate-to-source voltages $V_{GS33}$ and $V_{GS4}$ of the MOSFETs M103 and M104 are given as $$V_{GS3}=V_{G3}-V_{S3}=V_R+(\tfrac{1}{2})V_x-V_{S6}, \text{ and}$$

$$V_{GS4}=V_{G4}-V_{S4}=V_R-(\tfrac{1}{2})V_x-V_{S6}.$$

Accordingly, using the above equation (10), the drain currents $I_{D3}$ and $I_{D4}$ of the MOSFETs M103 and M104 are given by the following equations (11) and (12), respectively.

$$I_{D3} = \beta(V_{GS3} - V_{TH})^2 = \beta\left(V_R + \frac{1}{2}V_x - V_{S6} - V_{TH}\right)^2 = \beta\left[\frac{1}{2}V_x - \frac{1}{2}V_y + \sqrt{\frac{I_{B1}}{\beta}}\right]^2 \quad (11)$$

$$I_{D4} = \beta\left[-\frac{1}{2}V_x - \frac{1}{2}V_y + \sqrt{\frac{I_{B1}}{\beta}}\right]^2 \quad (12)$$

As a result, from these equations (11) and (12), the differential current of the MOSFETs M103 and M104 is expressed by the following equation (13).

$$I_{D3} - I_{D4} = 2\beta V_x\left[-\frac{1}{2}V_y + \sqrt{\frac{I_{B1}}{\beta}}\right] \quad (13)$$

The drains of the MOSFETs M101 and M103 are commonly connected to the input terminal of the current mirror circuit 105. Therefore, an input current i9 of the current mirror circuit 105 is expressed by the sum of the drain currents $I_{D1}$ and $I_{D3}$; i.e., $i_9=I_{D1}+I_{D3}$.

A mirror current $i_{10}$ of the current $i_9$, which is equal to $i_9$, is outputted by the current mirror circuit 105 and then, is inputted into the input terminal of the current mirror circuit 107. A mirror current i13, which is equal to $i_9$, is outputted by the current mirror circuit 107.

Similarly, the drains of the MOSFETs M102 and M104 are commonly connected to the input terminal of the current mirror circuit 106. Therefore, an input current $i_{11}$ of the current mirror circuit 106 is expressed by the sum of the drain currents $I_{D2}$ and $I_{D4}$; i.e., $i_{11}=I_{D2}+I_{D4}$.

A mirror current $i_{12}$ of the current $i_{11}$, which is equal to $i_{11}$, is outputted by the current mirror circuit 106 and then, is inputted into the output terminal of the current mirror circuit 107.

As a result, a differential output current $i_{out}$ of the conventional multiplier shown in FIG. 1 is expressed as the following expression (14).

$$\begin{aligned} i_{out} &= i_{12} - i_{13} = (I_{D2} + I_{D4}) - (I_{D1} + I_{D3}) \\ &= -(I_{D3} - I_{D4}) - (I_{D1} - I_{D2}) \\ &= 2\beta V_x V_y \end{aligned} \tag{14}$$

It is seen from the above expression (14) that the differential output current $i_{out}$ is proportional to the product $V_x \cdot V_y$ of the first and second differential input voltages $V_x$ and $V_y$, which realizes a four-quadrant multiplier operation.

Although the conventional CMOS multiplier shown in FIG. 1 realizes a complete linear operation, there is a problem that the frequency characteristic degrades. This is because the p-channel MOSFETs M107 and M108, which are inferior in frequency characteristic to n-channel MOSFETS, are used in the signal paths.

Also, the drain currents $I_{D7}$ and $I_{D8}$ of the MOSFETs M107 and M108, which do not appear in the differential output current $i_{out}$, need to flow into the first and second triple-tail cells, respectively. The drain currents $I_{D7}$ and $I_{D8}$ are typically set as comparatively large. Consequently, there is another problem that a circuit current increases.

Further, to raise the maximum operable input voltages, a larger current needs to be supplied to this conventional multiplier. Specifically, if the input voltage $V_y$ becomes high, the source voltages $V_{S5}$ and $V_{S6}$ need to be raised according to the input voltage $V_y$. In this case, the drain currents $I_{D7}$ and $I_{D8}$ of the MOSFETs M107 and M108 will be necessarily large. This leads to further circuit-current increase.

An analog multiplier is an essential function block in the analog signal applications.

Also, the need of a CMOS analog multiplier has been becoming stronger and stronger in recent years.

SUMMARY OF THE INVENTION

Accordingly, an object of the present invention is to provide an analog multiplier that decreases the circuit current consumption.

Another object of the present invention is to provide an analog multiplier having an improved frequency characteristic.

Still another object of the present invention is to provide a CMOS analog multiplier having an improved frequency characteristic.

The above objects together with others not specifically mentioned will become clear to those skilled in the art from the following description.

According to the present invention, an analog multiplier for multiplying first and second input signals is provided.

This multiplier includes (a) a first triple-tail cell of first, second, and third transistors driven by a first tail current, (b) a second triple-tail cell of fourth, fifth, and sixth transistors driven by a second tail current, (c) a first constant current source/sink supplying/sinking a first constant current to/from the third transistor, (d) a second constant current source/sink supplying/sinking a second constant current to/from the sixth transistor, (e) a first tail current controller controlling the first tail current, and (f) a second tail current controller controlling the second tail current.

The first and second transistors have a first pair of input terminals and a first pair of output terminals. The third transistor has a first input terminal. The fourth and fifth transistors have a second pair of input terminals and a second pair of output terminals. The sixth transistor has a second input terminal. The first pair of output terminals are cross-coupled with the second pair of output terminals, thereby forming a pair of multiplier output terminals.

The first input signal is applied across the first pair of input terminals of the first and second transistors. The first input signal is applied across the second pair of input terminals of the fourth and fifth transistors. The second input signal is applied across the first and second input terminals. A multiplier output signal is differentially derived from the pair of multiplier output terminals.

The first tail current controller controls the first tail current to cancel a first change of a current flowing through the third transistor, where the first change is caused by the second input voltage applied to the first input terminal of the third transistor.

The second tail current controller controls the second tail current to cancel a second change of a current flowing through the sixth transistor, where the second change is caused by the second input voltage applied to the second input terminal of the sixth transistor.

With the analog multiplier according to the present invention, the first triple-tail cell is driven by the first tail current, and no other current flows through the first triple-tail cell. Although the first constant current is supplied/sunk by the first constant current source/sink in the first triple-tail cell, the first constant current is included in the first tail current.

Similarly, the second triple-tail cell is driven by the second tail current, and no other current flows through the second triple-tail cell. Although the second constant current is supplied/sunk by the second constant current source/sink in the second triple-tail cell, the second constant current is included in the second tail current.

Accordingly, no redundant current needs to flow through the first and second triple-tail cells other than the first and second tail currents. As a result, the circuit current consumption is decreased.

On the other hand, the first tail current controller controls the first tail current to cancel the first change of the current flowing through the third transistor, and the second tail current controller controls the second tail current to cancel the second change of the current flowing through the sixth transistor, where the first and second changes are caused by the second input voltage.

Therefore, the multiplier output differentially derived from the pair of multiplier output terminals is proportional to the product of the first and second input signals.

In a preferred embodiment of the multiplier according to the present invention, the first to sixth transistors are formed by MOSFETS. In this case, this multiplier may be composed of n-channel MOSFETs only, without using p-channel MOSFETs which are inferior in frequency characteristic to n-channel MOSFETs. As a result, the frequency characteristic is improved.

If the first to sixth transistors are formed by n-channel MOSFETs and other transistors such as current sources are formed by p-channel MOSFETs, a CMOS analog multiplier having an improved frequency characteristic is provided.

In another preferred embodiment of the multiplier according to the present invention, the first to sixth transistors are formed by bipolar transistors with emitter resistors. Because the square-law characteristic of an MOSFET is approximated by the characteristic of a bipolar transistor with an emitter resistor, bipolar transistors with emitter resistors may be used as the first to sixth transistors.

In still another preferred embodiment of the multiplier according to the present invention, the first tail current controller includes a seventh transistor connected to the first triple-tail cell and the second tail current controller includes an eighth transistor connected to the second triple-tail cell. The seventh transistor supplies/sinks the first tail current according to an output of the third transistor. The eighth transistor supplies/sinks the second tail current according to an output of the sixth transistor.

In this case, it is preferred that the output of the third transistor is applied to the seventh transistor through a first emitter/source-follower transistor, and the output of the sixth transistor is applied to the eighth transistor through a second emitter/source-follower transistor.

Moreover, it is preferred that the first tail current controller includes a first constant voltage source for shifting a voltage level of the output of the third transistor, and the second tail current controller includes a second constant voltage source for shifting a voltage level of the output of the sixth transistor.

In a further preferred embodiment of the multiplier according to the present invention, the third transistor and the first tail current controller form a first negative-feedback current loop, and the sixth transistor and the second tail current controller form a second negative-feedback current loop.

In a still further preferred embodiment of the multiplier according to the present invention, the first tail current controller controls the first tail current in such a way that the first, second, and third transistors are not cut off, and the second tail current controller controls the second tail current in such a way that the fourth, fifth, and sixth transistors are not cut off.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Preferred embodiments of the present invention will be described below with reference to the drawings attached.

First Embodiment

Figure 2:
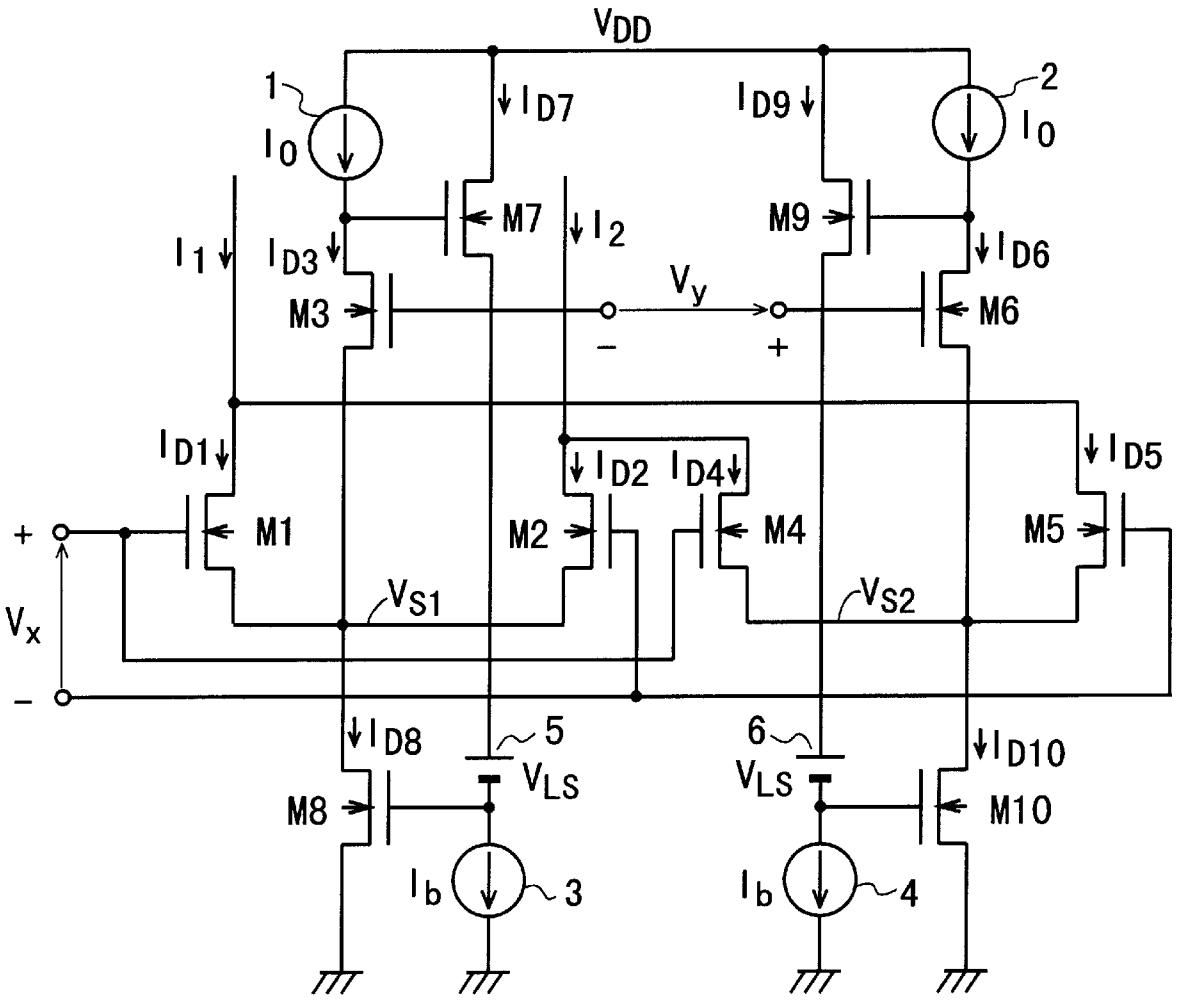
FIG. 2 is a circuit diagram of a MOS analog multiplier according to a first embodiment of the present invention.

A MOS analog multiplier according to a first embodiment of the present invention is shown in FIG. 2.

As shown in FIG. 2, this multiplier includes a first triple-tail cell of n-channel MOSFETs M1, M2, and M3 whose sources are coupled together and a second triple-tail cell of n-channel MOSFETs M4, M5, and M6 whose sources are coupled together.

The coupled sources of the MOSFETs M1, M2, and M3 of the first triple-tail cell are connected to a drain of an n-channel MOSFET M8. The first triple-tail cell is driven by a drain current $ID_8$ of the MOSFET M8 serving as a first tail current. A source of the MOSFET M8 is connected to the ground.

The coupled sources of the MOSFETs M4, M5, and M6 of the second triple-tail cell are connected to a drain of an n-channel MOSFET M10. The second triple-tail cell is driven by a drain current $I_{D10}$ of the MOSFET M10 serving as a second tail current. A source of the MOSFET M10 is connected to the ground.

Gates of the MOSFETs M1 and M2 form a first pair of input terminals. Gates of the MOSFETs M5 and M4 form a second pair of input terminals. The first and second pairs of the input terminals are parallel-coupled to be applied with a first differential input voltage $V_x$. In other words, the first differential input voltage $V_x$ is applied across the first triple-tail cell at the gates of the MOSFETs M1 and M2 and across the second triple-tail cell at the gates of the MOSFETs M5 and M4.

Drains of the MOSFETs M1 and M2 form a first pair of output terminals. Drains of the MOSFETs M4 and M5 form a second pair of output terminals. The drains of the MOSFETs M1 and M5 are coupled together to form one of a pair of multiplier output terminals. The drains of the MOSFETs M2 and M4 are coupled together to form the other of the pair of multiplier output terminals. Thus, the first and second pairs of the output terminals are cross-coupled to thereby form the pair of multiplier output terminals. A multiplier output current is differentially derived from the pair of multiplier output terminals.

A gate of the MOSFET M3 forms a first input terminal. A gate of the MOSFET M6 forms a second input terminal. The first and second input terminals are applied with a second differential input voltage $V_y$. In other words, the second differential input voltage $V_y$ is applied across the first and second triple-tail cells at the gates of the MOSFETs M3 and M6.

A drain of the MOSFET M3 is connected to one terminal of a constant current source 1. The other terminal of the constant current source 1 is applied with a power supply voltage $V_{DD}$. The constant current source 1 supplies a constant current $I_0$ to the MOSFET M3. In other words, the constant current source 1 drives the MOSFET M3 by the constant current $I_0$.

A drain of the MOSFET M6 is connected to one terminal of another constant current source 2. The other terminal of the constant current source 2 is applied with the power supply voltage $V_{DD}$. The constant current source 2 supplies a same constant current $I_0$ as the constant current source 1 to the MOSFET M6. In other words, the constant current source 2 drives the MOSFET M6 by the same constant current $I_0$ as the constant current source 1.

An n-channel MOSFET M7, a constant voltage source 5, and a constant current sink 3 are further provided for the first triple-tail cell. The constant voltage source 5 supplies a constant dc voltage $V_{LS}$. The constant current source 3 sinks a constant current $I_b$.

A drain of the MOSFET M7 is applied with the power supply voltage $V_{DD}$. A gate of the MOSFET M7 is connected to the drain of the MOSFET M3, and therefore, the MOSFET M7 is controlled by the drain voltage of the MOSFET M3. A source of the MOSFET M7 is connected to a positive terminal of the constant voltage source 5. A negative terminal of the constant voltage source 5 is connected to one terminal of the constant current sink 3 and a gate of the MOSFET M8. The other terminal of the constant current sink 3 is connected to the ground. The drain current (i.e., the first tail current) $I_{D8}$ of the MOSFET MS is controlled by the voltage at the negative terminal of the constant voltage source 5.

The MOSFETs M7 and M8, the constant voltage source 5, and the constant current sink 3 constitute a first tail current controller for controlling the first tail current $I_{D8}$. Also, the MOSFETs M3, M7, and M8, and the constant voltage source 5 constitute a first negative-feedback current loop, where the MOSFET M7 serves as a source-follower transistor. The MOSFET M7 serves to supply a necessary current to the voltage source 5 and therefore, this MOSFET M7 may be termed a voltage-level shifter.

When the second input voltage $V_y$ is applied to the gate of the MOSFET M3, the drain current $I_{D3}$ of the MOSFET M3 tends to vary due to the change of the gate-to-source voltage of the MOSFET M3 according to the voltage $V_y$. However, the drain current $I_{D3}$ is kept at $I_0$ by the constant current source 1. Then, the first tail current controller serves to cancel the possible change of the drain current $I_{D3}$ through the change of the first tail current $I_{D8}$. In other words, the change of the drain current $I_{D3}$ in the first triple-tail cell, which is caused by the applied second input voltage $V_y$, is negatively fed back to the first triple-tail cell.

No gate current flows to the gate of the MOSFET M8. Therefore, if the constant current source 3 is not provided between the constant voltage source 5 and the ground, the MOSFET M8 will be cut off. The constant current source 3 serves to prevent this cut off behavior of the MOSFET M8 and to ensure the desired operation thereof.

Similarly, an n-channel MOSFET M9, a constant voltage source 6, and a constant current sink 4 are further provided for the second triple-tail cell. The constant voltage source 6 supplies a same constant dc voltage $V_{LS}$ as the constant voltage source 5. The constant current sink 4 sinks a same constant current $I_b$ as the constant current sink 3.

A drain of the MOSFET M9 is applied with the power supply voltage $V_{DD}$. A gate of the MOSFET M9 is connected to the drain of the MOSFET M6, and therefore, the MOSFET M9 is controlled by the drain voltage of the MOSFET M6. A source of the MOSFET M9 is connected to a positive terminal of the constant voltage source 6. A negative terminal of the constant voltage source 6 is connected to one terminal of the constant current sink 4 and a gate of the MOSFET M10. The other terminal of the constant current sink 4 is connected to the ground. The drain current (i.e., the second tail current) $I_{D10}$ of the MOSFET M10 is controlled by the voltage at the negative terminal of the constant voltage source 6.

The MOSFETs M9 and M10, the constant voltage source 6, and the constant current sink 4 constitute a second tail current controller for controlling the second tail current $I_{D10}$. Also, the MOSFETs M6, M9, and M10, and the constant voltage source 6 constitute a second negative-feedback current loop, where the MOSFET M10 serves as a source-follower transistor. The MOSFET M9 serves to supply a necessary current to the voltage source 6 and therefore, this MOSFET M9 may be termed a voltage-level shifter.

When the second input voltage $V_y$ is applied to the gate of the MOSFET M6, the drain current $I_{D6}$ of the MOSFET M6 tends to vary due to the change of the gate-to-source voltage of the MOSFET M6 according to the voltage $V_y$. However, the drain current $I_{D6}$ is kept at $I_0$ by the constant current source 2. Then, the second tail current controller serves to cancel the possible change of the drain current $I_{D6}$ through the change of the second tail current $I_{D10}$. In other words, the change of the drain current $I_{D6}$ in the second triple-tail cell, which is caused by the applied second input voltage $V_y$. is negatively fed back to the second triple-tail cell.

No gate current flows to the gate of the MOSFET M10. Therefore, if the constant current source 4 is not provided between the constant voltage source 6 and the ground. the MOSFET M10 will be cut off. The constant current source 4 serves to prevent this cut off behavior of the MOSFET M10 and to ensure the desired operation thereof.

Figure 1:
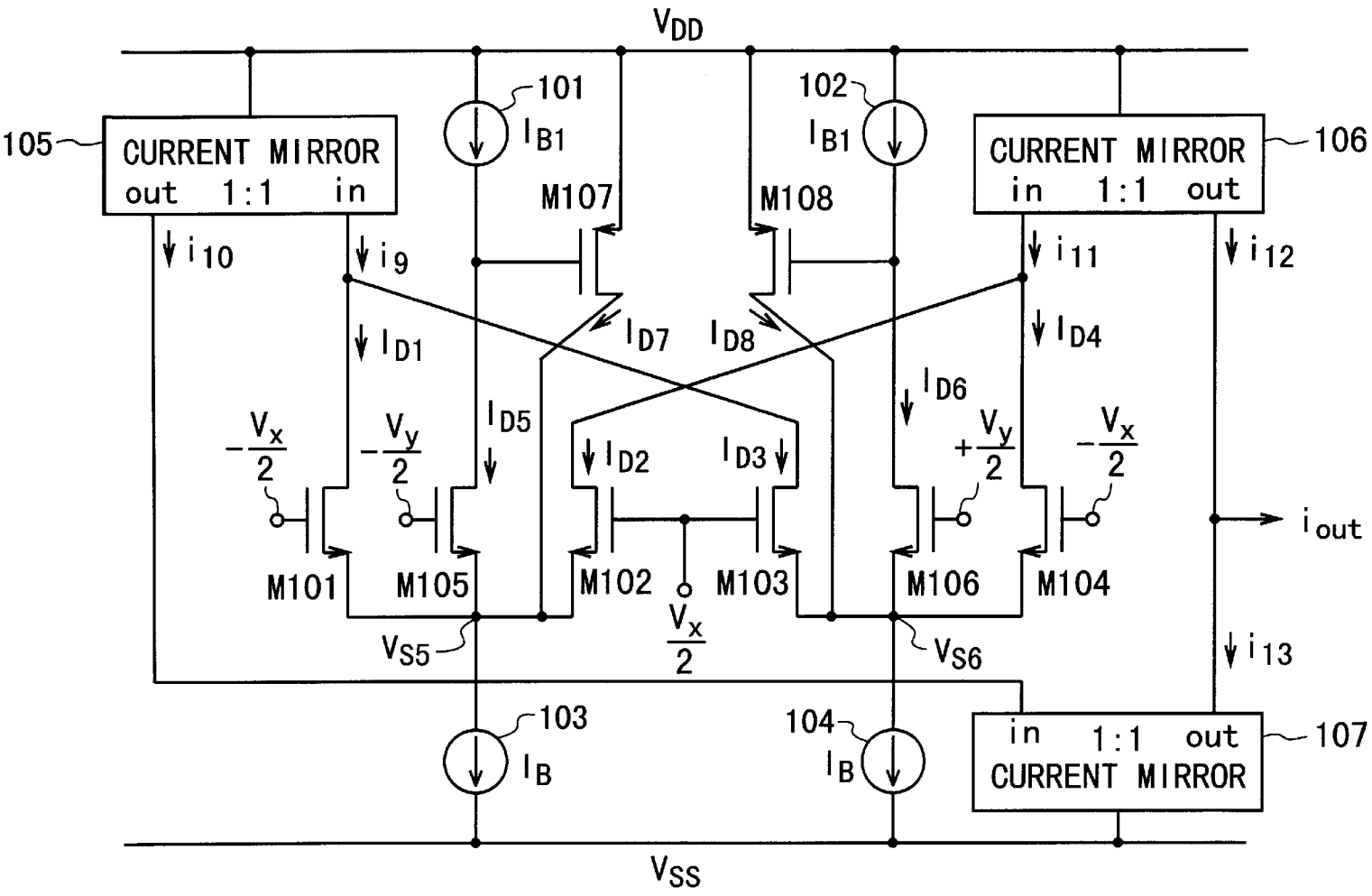
FIG. 1 PRIOR ART
FIG. 1 is a circuit diagram of a conventional four-quadrant CMOS analog multiplier.

As seen from FIG. 2, the MOSFETs M3, M7, and M8 have the same conductivity type and constitute a negative-feedback current loop in the first triple-tail cell. Similarly, the MOSFETs M6, M9, and M10 have the same conductivity type and constitute another negative-feedback current loop in the second triple-tail cell. These configurations are clearly different from those of the conventional multiplier shown in FIG. 1 where the drain currents $I_{D7}$ and $I_{D8}$ flowing through the current loop formed by the MOSFETs M105 and M107 in the first triple-tail cell and that formed by the MOSFETs M106 and M108 in the second triple-tail cell are changed to thereby control the effective tail currents for the first and second triple-tail cells.

Next, the operation principle of the MOS multiplier according to the first embodiment shown in FIG. 2 is explained below.

In the first triple-tail cell, because the MOSFET M3 is driven by the constant current $I_0$ supplied from the constant current source 1, a gate-to-source voltage $V_{GS3}$ of the MOSFET M3 is kept at a specific constant value to flow the drain current $I_{D3}$ equal to $I_0$. When the second input voltage $V_y$ is applied across the second pair of input terminals (i.e., across the gates of the MOSFETs M3 and M6), a gate voltage $V_{G3}$ of the MOSFET M3 is changed according to the applied second input voltage $V_y$. Then, to keep the gate-to-source voltage $V_{GS3}$ of the MOSFET M3 at the specific constant value, a common source voltage $V_{S1}$ of the MOSFETS M1, M2, and M3 needs to vary according to the change of the gate voltage $V_{G3}$.

When the gate voltage $V_{G3}$ of the MOSFET M3 is given as $[V_R-(½)V_y]$, where $V_R$ is a specific reference voltage, the gate-to-source voltage $V_{GS3}$ of the MOSFET M3 is expressed as $$V_{GS3}=V_{G3}-V_{S1}=[V_R-(½)V_y]-V_{S1}.$$

Accordingly, using the previously-described general equation (1), the drain current $I_{D3}$ of the MOSFET M3 is given by the following equation (15).

$$I_{D3}=\beta(V_{GS3}-V_{TH})^2=\beta(V_R-½V_y-V_{S1}-V_{TH})^2=I_0 \quad (15)$$

Thus, the common source voltage $V_{S1}$ is expressed as the following equation (16).

$$V_{S1} = V_R - \frac{1}{2}V_y - V_{TH} - \sqrt{\frac{I_0}{\beta}} \quad (16)$$

It is seen from the equation (16) that the MOSFET M3 serves to change or shift the common source voltage $V_{S1}$ according to the gate voltage $V_{G3}$ or the applied second input voltage $V_y$. Therefore, the MOSFET M3 serves as a common-source-voltage shifter.

Similarly, when the gate voltages $V_{G1}$ and $V_{G2}$ of the MOSFETs M1 and M2 are given as $[V_R+(½)V_x]$ and $[V_R-(½)V_x]$, the gate-to-source voltages $V_{GS1}$ and $V_{GS2}$ of the MOSFETs M1 and M2 are expressed as $$V_{GS1}=V_{G1}-V_{S1}=[V_R+(½)V_x]-V_{S1}.$$

$$V_{GS2}=V_{G2}-V_{S1}[V_R-(½)V_x]-V_{S1}.$$

As a result, the drain currents $I_{D1}$ and $I_{D2}$ of the MOSFETs M1 and M2 are given by the following equations (17) and (18) by using the previously-described general equation (1), respectively.

$$I_{D1} = \beta(V_{GS1} - V_{TH})^2 = \beta\left(V_R + \frac{1}{2}V_x - V_{S1} - V_{TH}\right)^2 = \beta\left(\frac{1}{2}V_x + \frac{1}{2}V_y + \sqrt{\frac{I_0}{\beta}}\right)^2 \quad (17)$$

$$I_{D2} = \beta(V_{GS2} - V_{TH}) = \beta\left(V_R - \frac{1}{2}V_x - V_{S1} - V_{TH}\right)^2 = \beta\left(-\frac{1}{2}V_x + \frac{1}{2}V_y + \sqrt{\frac{I_0}{\beta}}\right)^2 \quad (18)$$

Accordingly, the differential output current $(I_{D1}-I_{D2})$ of the first triple-tail cell is expressed as $$I_{D1} - I_{D2} = 2\beta V_x\left(\frac{1}{2}V_y + \sqrt{\frac{I_0}{\beta}}\right) \quad (19)$$

Similarly, in the second triple-tail cell, because the MOSFET M6 is driven by the constant current $I_0$ supplied frbm the constant current source 2, a gate-to-source voltage $V_{GS6}$ of the MOSFET M6 is kept at a specific constant value to flow the drain current $I_{D6}$ equal to $I_0$. When the second input voltage $V_y$ is applied across the second pair of input terminals (i.e., across the gates of the MOSFETs M3 and M6), a gate voltage $V_{G6}$ of the MOSFET M6 is changed according to the applied second input voltage $V_y$. Then, to keep the gate-to-source voltage $V_{GS6}$ of the MOSFET M6 at the specific constant value, a common source voltage $V_{S2}$ of the MOSFETs M4, M5, and M6 needs to vary according to the change of the gate voltage $V_{G6}$.

When the gate voltage $V_{G6}$ of the MOSFET M6 is given as $[V_R+(½)V_y]$, the gate-to-source voltage $V_{GS6}$ of the MOSFET M6 is expressed as $$V_{GS6}=V_{G6}-V_{S2}=[V_R+(½)V_y]-V_{S2}.$$

Accordingly, using the previously-described general equation (1), the drain current $I_{D6}$ of the MOSFET M6 is given by the following equation (20).

$$I_{D6}=\beta(V_{GS6}-V_{TH})^2=\beta(V_R+½V_y-V_{S2}-V_{TH})^2=I_0 \quad (20)$$

Thus, the common source voltage $V_{S2}$ is expressed as the following equation (21).

$$V_{S2} = V_R + \frac{1}{2}V_y - V_{TH} - \sqrt{\frac{I_0}{\beta}} \quad (21)$$

It is seen from the equation (21) that the MOSFET M6 serves to change or shift the common source voltage $V_{S2}$ according to the gate voltage $V_{G6}$ or the applied second input voltage $V_y$. Therefore, the MOSFET M6 serves as a common-source-voltage shifter.

Similarly, when the gate voltages $V_{G4}$ and $V_{G5}$ of the MOSFETs M4 and M5 are given as $[V_R+(½)V_x]$ and $[V_R-(½)V_x]$, the gate-to-source voltages $V_{GS4}$ and $V_{GS5}$ of the MOSFETs M4 and M5 are expressed as $$V_{GS4}=V_{G4}-V_{S2}=[V_R+(½)V_x]-V_{S2}.$$

$$V_{GS5}=V_{G5}-V_{S2}=[V_R-(½)V_x]-V_{S2}.$$

As a result, the drain currents $I_{D4}$ and $I_{D5}$ of the MOSFETs M4 and M5 are given by the following equations (22) and (23) by using the previously-described general equation (1), respectively.

$$I_{D4} = \beta(V_{GS4} - V_{TH})^2 = \beta\left(V_R + \frac{1}{2}V_x - V_{S2} - V_{TH}\right)^2 = \beta\left(\frac{1}{2}V_x - \frac{1}{2}V_y + \sqrt{\frac{I_0}{\beta}}\right)^2 \quad (22)$$

$$I_{D5} = \beta(V_{GS5} - V_{TH}) = \beta\left(V_R - \frac{1}{2}V_x - V_{S2} - V_{TH}\right) = \beta\left(-\frac{1}{2}V_x - \frac{1}{2}V_y + \sqrt{\frac{I_0}{\beta}}\right)^2 \quad (23)$$

Accordingly, the differential output current $(I_{D4}-I_{D5})$ of the second triple-tail cell is expressed as $$I_{D4} - I_{D5} = 2\beta V_x\left(-\frac{1}{2}V_y + \sqrt{\frac{I_0}{\beta}}\right) \quad (24)$$

A sum current $(I_{D1}+I_{D5})$ of the drain currents $I_{D1}$ and $I_{D5}$ of the MOSFETs M1 and M5 is given by $I_1$; i.e., $I_{D1}+I_{D5}=I_1$. Similarly, a sum current $(I_{D2}+I_{D4})$ of the drain currents $I_{D2}$ and $I_{D4}$ of the MOSFETs M2 and M4 is given by $I_2$; i.e., $I_{D2}+I_{D4}=I_2$.

As a result, the differential output current $\Delta I$ is expressed as the following expression (25).

$$\Delta I = I_1 - I_2 = (I_{D1} - I_{D2}) - (I_{D4} - I_{D5}) = 2\beta V_x V_y \quad (25)$$

As seen from the expression (25), the non-linear terms in the equations (19) and (24) are canceled. This realizes a completely-linear transfer characteristic.

It is seen from the above expression (25) that the differential output current $\Delta I$ of the multiplier includes the product $(V_x \cdot V_y)$ of the first and second differential input voltages $V_y$ and $V_y$, which realizes a four-quadrant analog multiplier operation.

With the analog multiplier according to the first embodiment in FIG. 2, the first triple-tail cell is driven by the first tail current $I_{D8}$ and no other current flows through the first triple-tail cell. Although the first constant current $I_0$ is supplied to the MOSFET M3 by the constant current source 1 in the first triple-tail cell, the constant current $I_0$ is included in the first tail current $I_{D8}$.

Similarly, the second triple-tail cell is driven by the second tail current $I_{D10}$, and no other current flows through the second triple-tail cell. Although the constant current $I_0$ is supplied to the MOSFET M6 by the constant current source 2 in the second triple-tail cell, the constant current $I_0$ is included in the second tail current $I_{D10}$.

Accordingly, no redundant current needs to flow through the first and second triple-tail cells other than the first and second tail currents $I_{D8}$ and $I_{D10}$. As a result, the circuit current consumption of the multiplier is decreased.

On the other hand, when the second input voltage $V_y$ is applied across the gates of the MOSFETs M3 and M6, the first tail current controller controls the first tail current $I_{D8}$ to cancel the change of the drain current $I_{D3}$ of the MOSFET M3, and at the same time, the second tail current controller controls the second tail current $I_{D10}$ to cancel the change of the drain current $I_{D6}$ of the MOSFET M6.

Therefore, the multiplier output ΔI is proportional to the product of the first and second input voltages $V_x$ and $V_y$.

Additionally, since the gate-to-source voltages $V_{GS5}$ and $V_{GS6}$ of the MOSFETs M3 and M6 are kept constant during operation, it is said that the MOSFETs M3 and M6 serve as "floating transistors".

Second Embodiment

Figure 3:
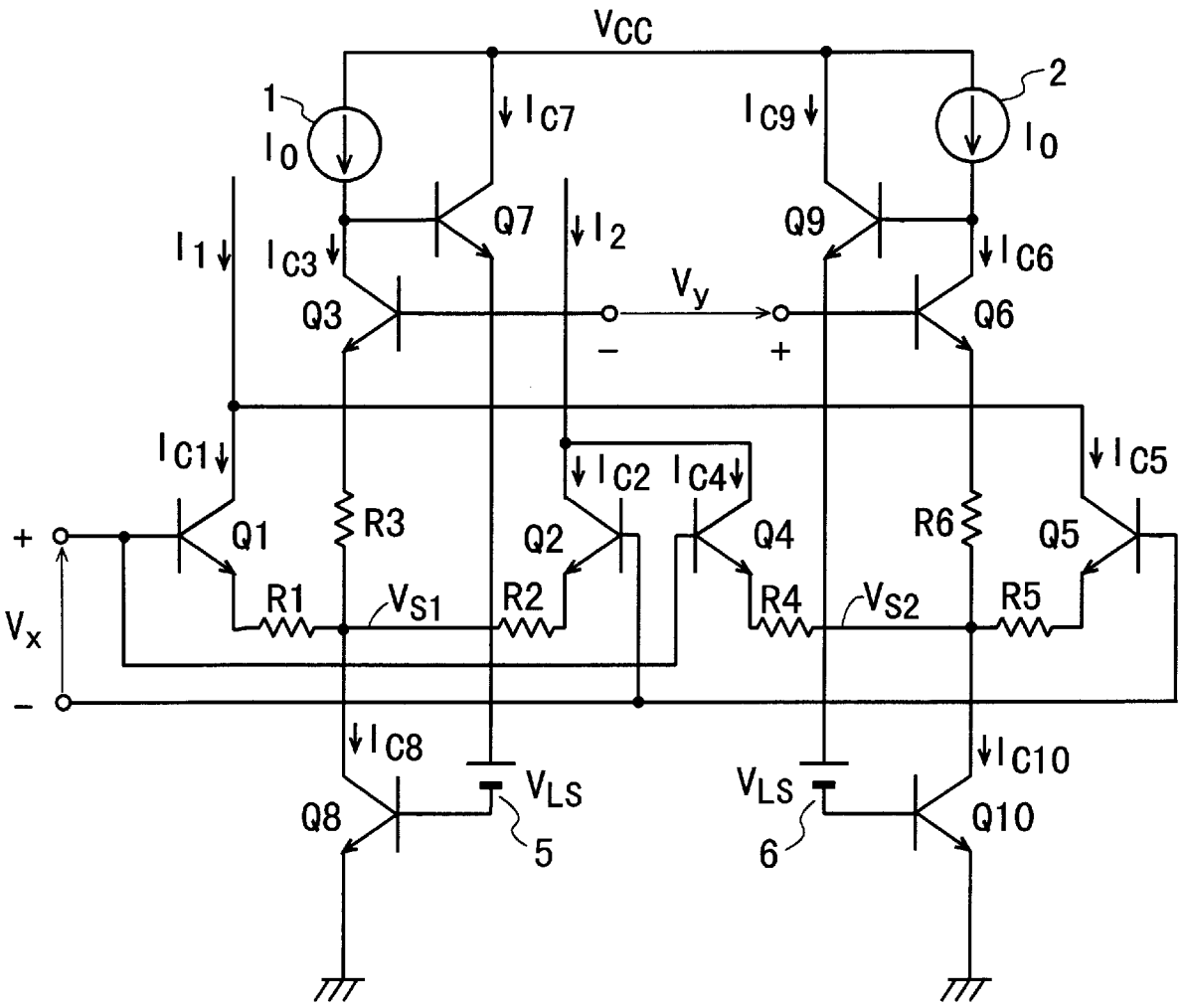
FIG. 3 is a circuit diagram of a bipolar multiplier according to a second embodiment of the present invention.

FIG. 3 shows a bipolar analog multiplier according to a second embodiment of the present invention.

The square-law characteristic of a MOSFET can be approximated by the characteristic given by the combination of a bipolar transistor and an emitter resistor.

Therefore, in the bipolar multiplier in FIG. 3, an npn-type bipolar transistor Q1 and an emitter resistor R1 are used as the MOSFET M1 in FIG. 2, an npn-type bipolar transistor Q2 and an emitter resistor R2 are used as the MOSFET M2 in FIG. 2, and an npn-type bipolar transistor Q3 and an emitter resistor R3 are used as the MOSFET M3 in FIG. 2 in the first triple-tail cell. Similarly, an npn-type bipolar transistor Q4 and an emitter resistor R4 are used as the MOSFET M4 in FIG. 2, an npn-type bipolar transistor Q5 and an emitter resistor R5 are used as the MOSFET M5 in FIG. 2, and an npn-type bipolar transistor Q6 and an emitter resistor R6 are used as the MOSFET M6 in FIG. 2 in the second triple-tail cell.

Further, npn-type bipolar transistors Q7, Q8, Q9, and Q10 are used as the MOSFETs M7, M8, M9, and M10 in FIG. 2, respectively.

The constant current sinks 3 and 4 in FIG. 2 are canceled in FIG. 3, because a base current flows through a base of a bipolar transistor and therefore, these current sinks 3 and 4 are not required.

The reference numerals $I_{C1}$, $I_{C2}$, $I_{C3}$, $I_{C4}$, $I_{C5}$, $I_{C6}$, $I_{C7}$, $I_{C8}$, $I_{C9}$, and $I_{C10}$ indicates collector currents of the bipolar transistors Q1, Q2, Q3, Q4, Q5, Q6, Q7, Q8, Q9, and Q10, respectively.

Since the operation principle of the bipolar transistor with the emitter resistor is very complicated and has been well known. Accordingly, it is not explained here for the sake of simplification.

The bipolar multiplier according to the second embodiment in FIG. 3 have the same advantages as those in the first embodiment in FIG. 2.

Third Embodiment

Figure 4:
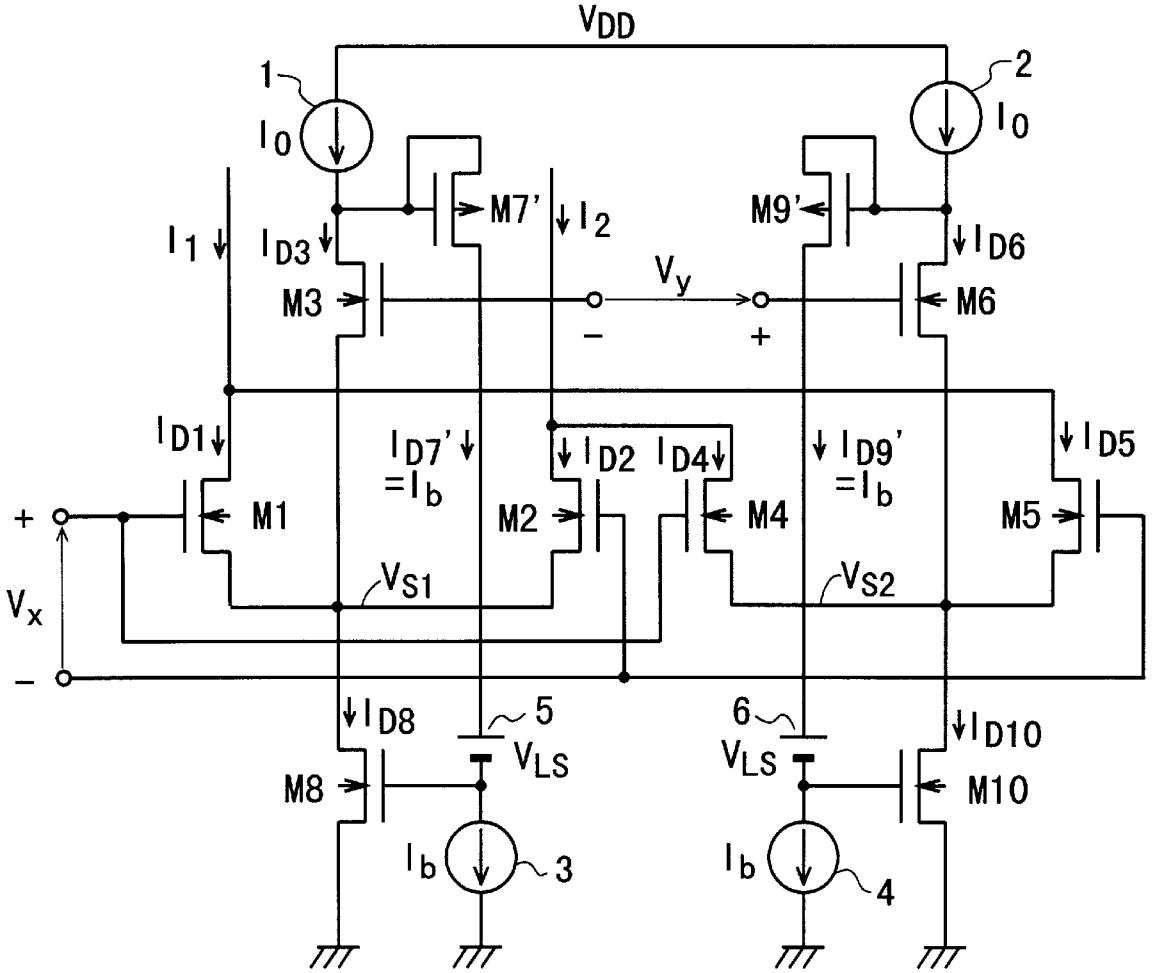
FIG. 4 is a circuit diagram of a MOS analog multiplier according to a third embodiment of the present invention.

FIG. 4 shows a CMOS analog multiplier according to a third embodiment of the present invention.

The CMOS multiplier according to the third embodiment has the same configuration as that of the multiplier according to the first embodiment in FIG. 2 except that p-channel MOSFETs M7' and M9' are used instead of the n-channel MOSFETs M7 and M8, respectively. A source and a gate of the p-channel MOSFET M7' are coupled together to be connected to the drain of the n-channel MOSFET M3. A source and a gate of the p-channel MOSFET M9' are coupled together to be connected to the drain of the n-channel MOSFET M6.

With the MOS multiplier according to the third embodiment in FIG. 4, the drain voltages $VD_3$ and $V_{D6}$ of the MOSFETs M3 and M6 are applied to the gates of the MOSFETs M8 and M10 through the diode-connected p-channel MOSFETs M7' and M9' and the constant voltage sources 5 and 6, respectively. The diode-connected MOSFETs M7' and M9' serve to shift the dc voltage level of the drain voltages $V_{D3}$ and $V_{D6}$, respectively. Drain currents $I_{D7}'$ and $I_{D9}'$ of the MOSFETs M7' and M9' are equal to the constant current $I_b$.

The operation principle of the MOS multiplier according to the third embodiment in FIG. 4 is the same as the MOS multiplier according to the first embodiment in FIG. 2. The MOS multiplier according to the third embodiment has the same advantages as those in the first embodiment.

Fourth Embodiment

Figure 5:
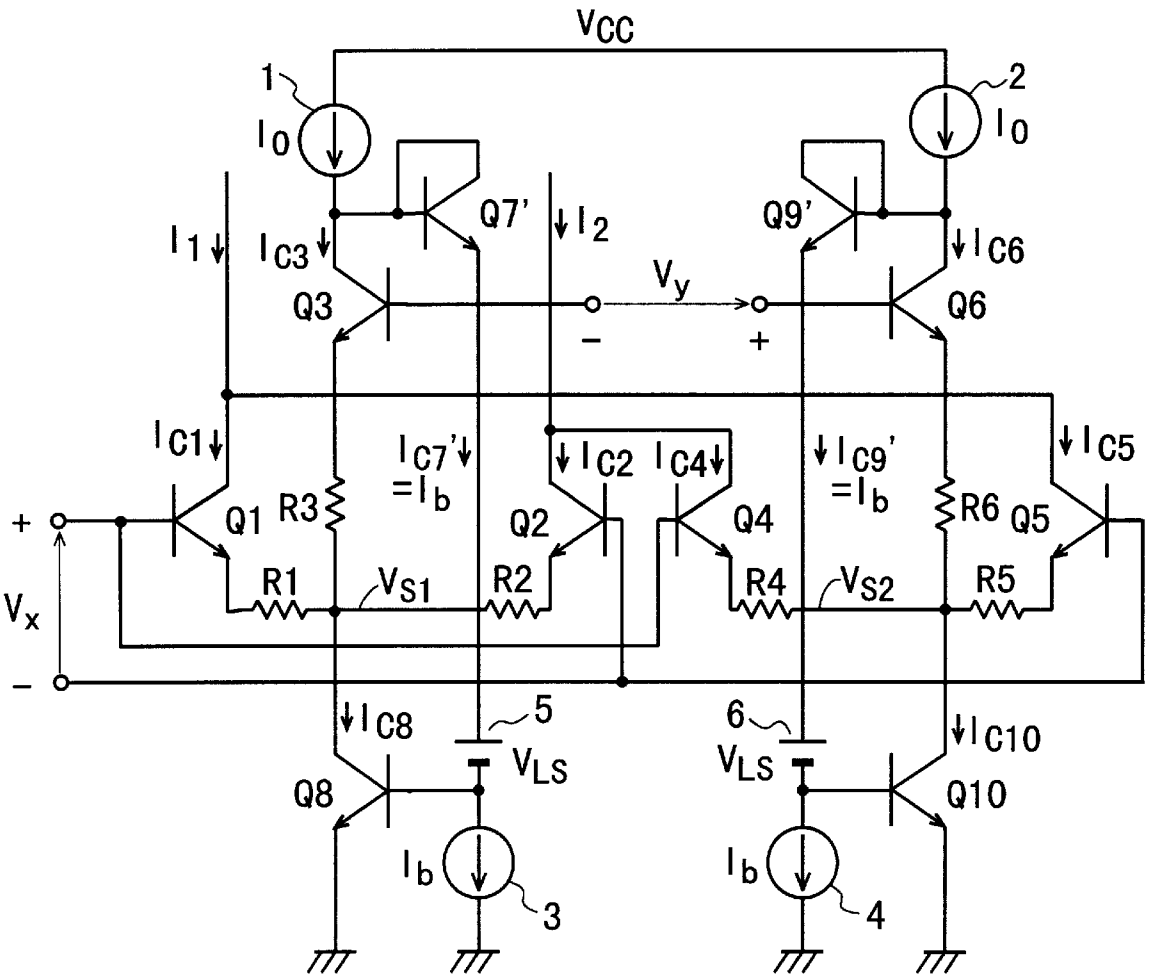
FIG. 5 is a circuit diagram of a bipolar multiplier according to a fourth embodiment of the present invention.

FIG. 5 shows a bipolar analog multiplier according to a fourth embodiment of the present invention.

The bipolar multiplier according to the fourth embodiment has the same configuration as that of the multiplier according to the second embodiment in FIG. 3 except that npn-type bipolar transistors Q7' and Q9' are used instead of the npn-type bipolar transistors Q7 and Q9, respectively. A collector and a base of the transistor Q7' are coupled together to be connected to the collector of the transistors Q3. A collector and a base of the transistor Q9' are coupled together to be connected to the collector of the transistor Q6.

With the MOS multiplier according to the fourth embodiment in FIG. 5, the collector voltages $V_{C3}$ and $V_{C6}$ of the transistors Q3 and Q6 are applied to the bases of the transistors Q8 and Q10 through the diode-connected transistors Q7' and Q9' and the constant voltage sources 5 and 6, respectively. The diode-connected transistors Q7' and Q9' serve to shift the dc voltage level of the collector voltages $V_{C3}$ and $V_{C6}$, respectively. Collector currents $I_{C7}'$ and $I_{C9}'$ of the transistors Q7' and Q9' are equal to the constant current $I_b$.

The operation principle of the bipolar multiplier according to the fourth embodiment in FIG. 5 is the same as the bipolar multiplier according to the second embodiment in FIG. 3. The bipolar multiplier according to the fourth embodiment has the same advantages as those in the second embodiment.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. An analog multiplier for multiplying first and second initial input signals;

said multiplier comprising:

(a) a first triple-tail cell of first, second, and third transistors driven by a first tail current;

said first and second transistors having a first pair of input terminals and a first pair of output terminals;

said third transistor having a first input terminal;

said first input signal being applied across said first pair of input terminals of said first and second transistors;

(b) a second triple-tail cell of fourth, fifth, and sixth transistors driven by a second tail current;

said fourth and fifth transistors having a second pair of input terminals and a second pair of output terminals;

said sixth transistor having a second input terminal;

said first pair of output terminals being cross-coupled with said second pair of output terminals, thereby forming a pair of multiplier output terminals;

said first input signal being applied across said second pair of input terminals of said fourth and fifth transistors;

said second input signal being applied across said first input terminal and said second input terminal;

a multiplier output signal being differentially derived from said pair of multiplier output terminals;

(c) a first constant current source supplying a first constant current to said third transistor;

(d) a second constant current source supplying a second constant current to said sixth transistor;

(e) a first tail current controller controlling said first tail current;

said first tail current controller controlling said first tail current to cancel a first change of a current flowing through said third transistor, where said first change is caused by said second input applied to said first input terminal of said third transistor; and (f) a second tail current controller controlling said second tail current;

said second tail current controller controlling said second tail current to cancel a second change of a current flowing through said sixth transistor, where said second change is caused by said second input applied to said second input terminal of said sixth transistor.

2. A multiplier as claimed in claim 1, wherein said first to sixth transistors are formed by MOSFETS.

3. A multiplier as claimed in claim 1, wherein said first to sixth transistors are formed by bipolar transistors with emitter resistors.

4. A multiplier as claimed in claim 3, wherein said first tail current controller includes a seventh transistor connected to said first triple-tail cell and said second tail current controller includes an eighth transistor connected to said second triple-tail cell;

and wherein said seventh transistor performs one of a current supply and current sink function with respect to said first tail current according to an output of said third transistor, and said eighth transistor performs one of a current supply and current sink function with respect to said second tail current according to an output of said sixth transistor.

5. A multiplier as claimed in claim 4, wherein said output of said third transistor is applied to said seventh transistor through a first emitter-follower transistor, and said output of said sixth transistor is applied to said eighth transistor through a second emitter-follower transistor.

6. A multiplier as claimed in claim 1, wherein said first tail current controller includes a seventh transistor connected to said first triple-tail cell and said second tail current controller includes an eighth transistor connected to said second triple-tail cell;

and wherein said seventh transistor performs one of a current supply and current sink function with respect to said first tail current according to an output of said third transistor, and said eighth transistor performs one of a current supply and current sink function with respect to said second tail current according to an output of said sixth transistor.

7. A multiplier as claimed in claim 6, wherein said output of said third transistor is applied to said seventh transistor through a first source-follower transistor, and said output of said sixth transistor is applied to said eighth transistor through a second source-follower transistor.

8. A multiplier as claimed in claim 6 wherein said first tail current controller includes a first constant voltage source for shifting a voltage level of said of said third transistor, and said second tail current controller includes a second constant voltage source for shifting a voltage level of said output of said sixth transistor.

9. A multiplier as claimed in claim 1, wherein said third transistor and said first tail current controller form a first negative-feedback current loop, and said sixth transistor and said second tail current controller form a second negative-feedback current loop.

10. A multiplier as claimed in claim 1, wherein said first tail current controller controls said first tail current in such a way that said first, second, and third transistors are not cut off, and said second tail current controller controls said second tail current in such a way that said fourth, fifth, and sixth transistors are not cut off.

* * * * *